United States Patent [19]
Ban et al.
[11] 4,357,986
[45] Nov. 9, 1982

[54] METHOD OF PRODUCING A FIBER-REINFORCED COMPOSITE ARTICLE

[75] Inventors: Keisuke Ban, Fujimi; Akimasa Daimaru, Asaka; Noriaki Miyake, Ueda, all of Japan

[73] Assignee: Honda Giken Kogyo Kabushiki Kaisha, Tokyo, Japan

[21] Appl. No.: 178,439

[22] Filed: Aug. 15, 1980

[30] Foreign Application Priority Data

Aug. 17, 1979 [JP] Japan ..... 54-104754

[51] Int. Cl.³ ..... B22D 18/02; B22D 19/14
[52] U.S. Cl. ..... 164/97; 164/108
[58] Field of Search ..... 164/97, 120, 108–110, 164/112, 80, 91

[56] References Cited

U.S. PATENT DOCUMENTS 1,172,363 2/1916 Jones ..... 164/112 X
1,333,593 3/1920 MacDermott ..... 164/108
2,285,811 6/1942 Gay ..... 164/109 X
4,266,596 5/1981 Ban et al. ..... 164/97

*Primary Examiner*—Gus T. Hampilos
*Assistant Examiner*—K. Y. Lin
*Attorney, Agent, or Firm*—Posnack, Roberts, Cohen & Spiecens

[57] ABSTRACT

A method of producing a fiber reinforced composite article comprising forming a shaped fiber body of predetermined configuration from inorganic fibers, placing a tubular member in the shaped fiber body, the tubular member having an opened end and a plurality of communication ports therein and charging a molten matrix alloy by squeeze casting from the outside of the shaped fiber body and, additionally, from the inside of the shaped fiber body through the tubular member. The article can be a connecting rod of an internal combustion engine and the shaped fiber body can be located at a position corresponding to a rib for reinforcing the connecting rod.

10 Claims, 2 Drawing Figures

METHOD OF PRODUCING A FIBER-REINFORCED COMPOSITE ARTICLE

FIELD OF THE INVENTION

The present invention relates to a method of producing a fiber-reinforced composite article.

PRIOR ART

We have previously proposed a method of producing a connecting rod for an internal combustion engine from fiber-reinforced composite material, wherein, in order to reinforce the area around the critical cross-section of the rod portion of the connecting rod with fibers, a shaped body consisting of bundles of unidirectional inorganic fibers is integrated with the rod portion by a squeeze casting, simultaneously with the casting of the connecting rod.

This fiber-reinforced connecting rod exhibits increased buckling strength and increased fatigue strength. For instance, the fiber-reinforced connecting rod has buckling strengths of 5,500 Kg and 8,217 Kg respectively in the direction of rotation and in a direction perpendicular to the direction of rotation as measured at a temperature of 200° C. These buckling strengths are relatively high compared with a conventional homogeneous connecting rod made of an aluminum alloy whose buckling strengths are 4,906 Kg and 3,876 Kg in the above-mentioned directions.

We have also made a further study on this fiber-reinforced connecting rod of superior mechanical strength and have reached various conclusions. Namely, as regards the buckling strength in the direction perpendicular to the direction of rotation of the connecting rod, the reinforcement by fibers at a reinforcement rib portion remote from the axis of the connecting rod is effective, and the reinforcement by fibers at the central portion thereof is not so effective. Also, fatigue failure is liable to start at the region near the rib, so that the reinforcement by fibers at the rib is effective also for avoiding the generation and propagation of fatigue failure.

In order to make improvements in this regard, it is necessary to increase the number of fibers employed and, hence, the concentration of the fibers at the rib portion. This, however, leads to an increase of fibers in the area around the axis of the connecting rod, resulting in the following problems.

1. In squeeze casting, when the shaped fiber body is filled with a molten metal under a high hydrostatic pressure, filling is effected both in the direction of the fibers and in a direction perpendicular to the fibers. The filling in the direction perpendicular to the fibers is made extremely difficult when the number of fibers is increased.

2. The increase of the number of fibers causes the heat capacity of the fibers to increase as a whole. In addition, there is only a small pre-heating effect. For these reasons, the molten metal is rapidly cooled (chilled) which adversely affects the filling operation.

3. Although it is true that the strength of the composite material is increased by increasing the number of the reinforcement fibers, from the view point of production costs, it is preferred to reinforce only those portions of the cross-section which require the reinforcement to avoid buckling and rupture due to fatigue.

SUMMARY OF THE INVENTION

Under these circumstances, an object of the present invention is to avoid the above-described problems of the prior art by providing a method of producing a fiber-reinforced composite article in which the reinforcement fibers are employed only where needed while improving the filling operation.

The above and other objects of the invention are satisfied by providing a method of producing a fiber-reinforced composite material comprising the steps of forming a shaped fiber body of a predetermined shape from inorganic fibers, placing a tubular member in the shaped fiber body, the tubular member having at least one open end and a plurality of communication ports therealong, and charging a molten matrix alloy both from the outside of the shaped body and also from the inside of the shaped body through the tubular member by squeeze casting thereby to form the composite article.

The inorganic fibers used in accordance with the invention are metallic fibers having high resiliency and high strength, such as stainless steel fibers, carbon fibers, or a yarn or whisker fiber assembly of ceramic fibers such as silicon carbide. The fibers are preferably bundled unidirectionally by a suitable pre-forming technique and are handled as a shaped fiber body. Other methods such as weaving, knitting and winding can also be used. In order to reduce weight and save labor, light alloys such as aluminum alloys, magnesium alloys and the like are preferably used as the matrix alloy.

It is also preferred that the tubular member be made of a material which can be dissolved and dispersed in the molten matrix alloy. For instance, the tubular member can be an aluminum tube having a plurality of bores disposed in the longitudinal direction or a continuous bore, such as a slit. It is also possible to use a tube having an open grid wall and tubes of other metallic material having a coating or layer of the above-mentioned material which can be dissolved in the matrix alloy.

DETAILED DESCRIPTION

Figure 1:
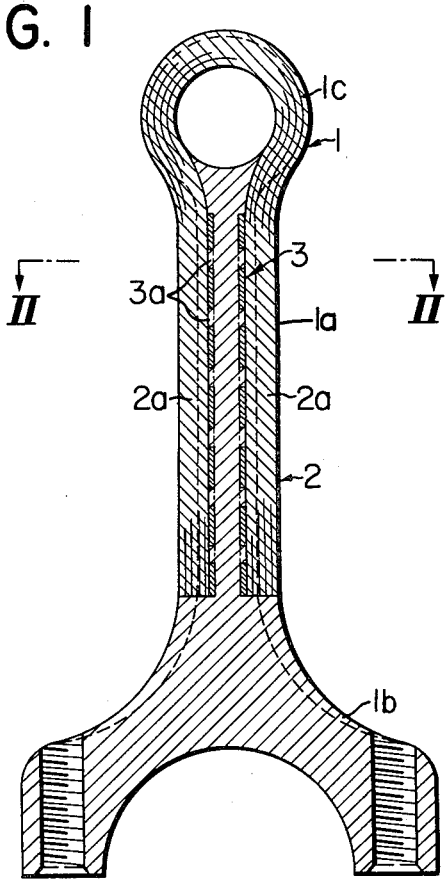
FIG. 1 is a sectional view taken along line I—I in FIG. 2 of a connecting rod for an internal combustion engine produced in accordance with the method of the invention.
Figure 2:
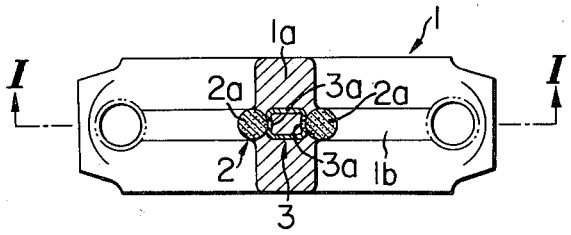
FIG. 2 is a sectional view taken along line II—II in FIG. 1.

A preferred embodiment of the invention will be described hereafter with specific reference to the drawing. Referring to FIGS. 1 and 2, therein is seen a connecting rod 1 for an internal combustion engine which incorporates a fiber bundle 2, for example, of unidirectional stainless steel fibers where are bent to form legs 2*a* between which is interposed an aluminum tube 3 of a thickness of about 2 mm. and having a plurality of communication ports 3*a* disposed therein along its length. The ends of the tube 3 are open. The assembly of the fiber bundle 2 and the tube 3 is installed in a mold (not shown) for forming the connecting rod. The fiber bundle 2, which is thus formed with parallel legs straddling the tube or tubular member 3, constitutes a continuous shaped fiber body which extends in correspondence with reinforcing ribs 1*b* of rod portion 1*a* of the connecting rod 1 and at the opposite end the fiber bundle 2 extends through the small end 1*c* of the connecting rod.

The tubular member 3, which supports the shaped fiber body before and during casting, is disposed at an axial position corresponding to the center of the rod portion 1*a*. Then, the mold is filled with a material (Japanese Industrial Standard AC 8B) as the matrix alloy by squeeze casting so that the connecting rod is formed with concentrations of reinforcement fibers at the reinforcing rib 1*b* of the rod portion 1*a* and at the small end 1*c* of the connecting rod. During the casting, the molten matrix alloy is charged both in the longitudinal direction of the fiber bundle 2 and, through the plurality of communicating ports 3*a* of the tubular member 3, in a direction perpendicular to the fiber bundle 2. The reinforcing rib 1*b* with the concentration of reinforcement fibers 2 acts as a concentric reinforcement for the rod portion 1*a*. The matrix alloy forming the connecting rod fills the space within the tubular member to form a central core which is integrated with the reinforcement fibers.

The present invention is also applicable to the production of fiber-reinforced composite products other than the described connecting rod for an internal combustion engine.

According to the invention, a space is formed in the shaped fiber body by the tubular member so that the molten matrix alloy can be supplied into the shaped fiber body from this internal space through communication ports formed in the wall of the tubular member. It is thus possible to reinforce effectively those portions of the cross-section which require reinforcement, while placing the tubular member at a location where the reinforcement with fibers is not necessary for increasing the buckling strength and fatigue strength of the product. In addition, the arrangement of the shaped fiber body in the mold is facilitated by the reinforcing effect provided by the tubular member disposed in the shaped fiber body. The tubular member is also effective in preventing distortion or deformation of the fibers in the longitudinal direction of the fibers.

Although the invention has been described in conjunction with a specific embodiment thereof, it will become apparent to those skilled in the art that numerous modifications and variations can be made within the scope and spirit in the invention as defined by the appended claims.

What is claimed is:

1. A method of producing a fiber-reinforced composite article comprising the steps of forming an assembly of a shaped fiber body of a predetermined shape from inorganic fibers with a tubular member in said shaped fiber body, said tubular member having an open end and a plurality of communication ports therein, and charging a molten matrix alloy by squeeze casting from the outside of said shaped fiber body and additionally from the inside of the shaped fiber body through said tubular member thereby to obtain the composite article.

2. A method of producing a fiber-reinforced composite article as claimed in claim 1, wherein said tubular member is made of a material which can be dissolved and dispersed in said molten matrix alloy.

3. A method of producing a fiber-reinforced composite article as claimed in claim 1 wherein said tubular member has a treated coating layer of a material which can be dissolved and dispersed in said molten matrix alloy.

4. A method of producing a fiber-reinforced composite article as claimed in claims 1, 2, or 3 wherein said composite article is a connecting rod of an internal combustion engine, said tubular member being disposed at a position corresponding to the center of a rod portion of said connecting rod while said shaped fiber body is located at a position corresponding to a rib for reinforcing said rod portion.

5. A method of producing a fiber-reinforced composite article as claimed in claim 1 wherein said tubular member is provided with said ports along the length of the tubular member for uniformly distributing the molten matrix alloy from the interior of the tubular member into said shaped fiber body via said ports.

6. A method of producing a fiber-reinforced composite article as claimed in claim 1 wherein said shaped fiber body is formed with parallel legs straddling said tubular member.

7. A method of producing a fiber-reinforced composite article as claimed in claim 1 wherein said tubular member supports said shaped fiber body before and during casting.

8. A method of producing a fiber-reinforced composite article as claimed in claim 1 wherein said assembly is produced by first forming said shaped fiber body and then placing the tubular body in said shaped body.

9. A method of producing a fiber-reinforced composite article as claimed in claim 1 wherein said tubular body has opposite ends both of which are open for receiving molten matrix alloy under pressure for discharging said alloy through said ports to said shaped fiber body.

10. A method of producing a fiber-reinforced composite article as claimed in claim 1 wherein the tubular body discharges said molten matrix alloy radially through said ports and perpendicularly to the fibers of said shaped body.

* * * * *